US006799944B2

(12) United States Patent
Andersson

(10) Patent No.: US 6,799,944 B2
(45) Date of Patent: Oct. 5, 2004

(54) ROTARY PUMP FOR PUMPING FLUIDS, MAINLY SEWAGE WATER

(75) Inventor: Patrik Andersson, Skogas (SE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/372,178

(22) Filed: Feb. 25, 2003

(65) Prior Publication Data

US 2003/0215331 A1 Nov. 20, 2003

(30) Foreign Application Priority Data

Apr. 26, 2002 (SE) ..... 0201254

(51) Int. Cl.[7] ..... F01D 25/00
(52) U.S. Cl. ..... 415/121.1; 415/121.2
(58) Field of Search ..... 415/121.1, 121.2

(56) References Cited

U.S. PATENT DOCUMENTS 3,096,718 A 7/1963 Anderson
4,347,035 A * 8/1982 Stahle ..... 415/121.1
4,402,648 A * 9/1983 Kretschmer ..... 415/121.1
4,454,993 A * 6/1984 Shibata et al. ..... 241/46.017
4,911,368 A * 3/1990 Nishimori ..... 241/46.017
5,011,370 A * 4/1991 Sodergard ..... 415/121.1
5,016,825 A * 5/1991 Carpenter ..... 241/46.06
6,139,260 A 10/2000 Arbeus

* cited by examiner

*Primary Examiner*—Hoang Nguyen
(74) *Attorney, Agent, or Firm*—Young & Thompson

(57) ABSTRACT

According to the invention the pump impeller comprises a hub (4) having one or several vanes swept backwards within a pump housing (1). The latter is provided with one or several relief grooves (8) on the inside of the pump housing wall. One or several radially directed scraping apparatus (10) are attached to the pump housing creating narrow slots at the leading edges (6) of the impeller vanes and causing pollutants on said edges to be fed into the grooves (8).

6 Claims, 3 Drawing Sheets

ROTARY PUMP FOR PUMPING FLUIDS, MAINLY SEWAGE WATER

Figure 1:
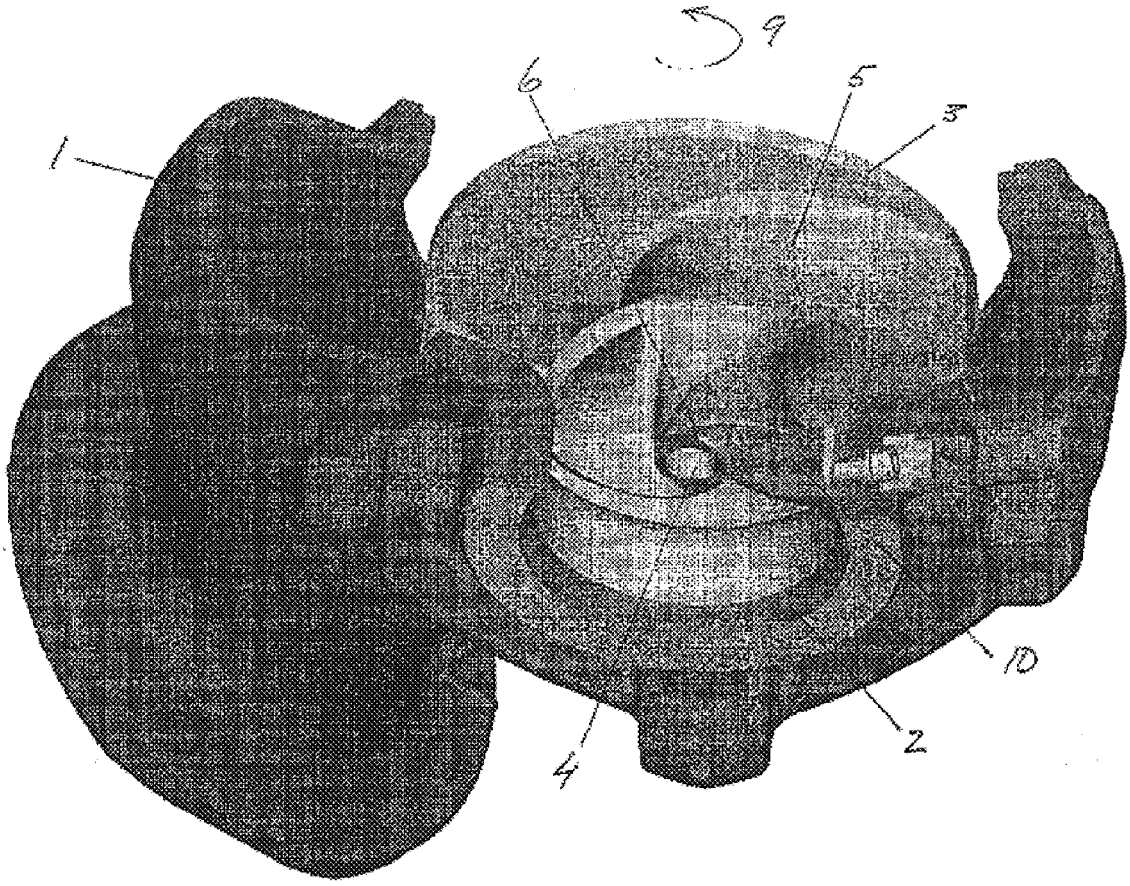

In literature there are lot of types of pumps and pump impellers for this purpose described, all however having certain disadvantages. Above all this concerns problems with clogging and low efficiency.

Sewage water contains a lot of different types of pollutants, the amount and structure of which depend on the season and type of area from which the water emanates. In cities plastic material, hygiene articles, textile etc are common, while industrial areas may produce wearing particles. Experience shows that the worst problems are rags and the like, which stick to the leading edges of the vanes and become wound around the impeller hub. Such incidents cause frequent service intervals and a reduced efficiency.

In agriculture and pulp industry different kinds of special pumps are used, which should manage straw, grass, leaves and other types of organic material. For this purpose the leading edges of the vanes are swept backwards in order to cause the pollutants to be fed outwards to the periphery instead of getting stuck to the edges.

Different types of disintegration means are often used for cutting the material and making the flow easier. Examples are shown in SE-435 952, SE-375 831 and U.S. Pat. No. 4,347,035.

As pollutants in sewage water are of other types more difficult to master and as the operation times for sewage water pumps normally are much longer, the above mentioned special pumps do not fulfill the requirements when pumping sewage water, neither from a reliability nor from an efficiency point of view.

A sewage water pump quite often operates up to 12 hours a day, which means that the energy consumption depends a lot on the total efficiency of the pump.

Tests have proven that it is possible to improve efficiency by up to 50% for a sewage pump according to the invention as compared with known sewage pumps. As the life cycle cost for an electrically driven pump normally is totally dominated by the energy cost (c:a 80%), it is evident that such a dramatic increase will be extremely important.

In literature the designs of the pump impellers are described very generally, especially as regards the sweep of the leading edges. An unambiguous definition of said sweep does not exist.

Tests have shown that the design of the sweep angle distribution on the leading edges is very important in order to obtain the necessary self-cleaning ability of the pump impeller. The nature of the pollutants also calls for different sweep angles in order to provide a good function.

Literature does not give any information about what is needed in order to obtain a gliding, transport, of pollutants outwards in a radial direction along the leading edges of the vanes. What is mentioned is in general that the edges shall be obtuse-angled, swept backward etc. See SE-435 952.

When smaller pollutants such as grass and other organic material are pumped, relatively small angles may be sufficient in order to obtain the radial transport and also to disintegrate the pollutants in the slot between pump impeller and the surrounding housing. In practice disintegration is obtained by the particles being cut through contact with the impeller and the housing when the former rotates having a periphery velocity of 10 to 25 m/s. This cutting process is improved by the surfaces being provided with cutting devices, slots or the like.

Different sorts of notches and cutting means are described in SE-435 952 and SE-375 831. They have all in common that the vane is located behind a shoulder. This means a considerable loss of efficiency as compared with an even contour, which is used in high efficiency pumps for clean water.

In SE-435 952 an embodiment is shown where an axial aperture is located behind a shoulder. The theory is that pollutants shall be fed outwards to said aperture by the vanes having leading edges strongly swept backwards. This embodiment, described very generally, is however not suitable to pump pollutants contained in sewage water.

In SE-375 831 a solution is described using the opposite principle that pollutants are transported towards the center, away from the slot. This fact, in combination with the previously mentioned shoulder, makes feeding into the slot impossible.

As previously mentioned, it is a condition that the leading edges of the vanes are swept strongly backwards in order to make possible a transport of the pollutants outwards and into the slot at the periphery. If this is not obtained, serous shut downs will occur very soon. Pump impellers of this type are described in SE-512 154 and SE-9704223-9. When the pollutants slide outwards and reach the slot between the vane and that pump housing wall, there is however a risk that they stick to the periphery of the leading edge and clog within the slot.

In DE-614 426 there is shown a device meant to solve such problems, without the need for the previously mentioned shoulder. The pump is a centrifugal pump having a very sharp linking from the axial inlet to the radial part of the flow channel. The periphery of the leading edge is here located downstream of said linking in the radial part of the channel.

A device is further mentioned which has a solid notch in front of the leading edge with a decreasing height up to a cutting knife, followed by a spiral formed groove with a triangular cross section and sharp corners which widens towards the periphery. In addition it is stated that the basic principle for this type of solution is that the replaceable cutting means shall disintegrate the pollutants. If this should fail, for instance if the cutting means is blunt, the consequence will be that the decreasing height of the notch will compress the pollutants to clog where the area has its minimum, i.e. within the area of said cutting means.

The above mentioned patent thus describes a solution which, under certain conditions, may obtain a self-cleaning ability, but which has got important disadvantages concerning efficiency, wear resistance and life. In addition there are no details given about the very important conditions regarding the leading edges of the vanes and thus it has no meaning to try to apply this described device when pumping sewage water.

In SE-9704729-4 is shown a design where a pump impeller with back swept vane leading edges rotating in a pump housing provided with a number of grooves in the inside wall. Said grooves facilitate the transport of pollutants going through the pump and in addition efficiency and wear resistance are increased.

This solution normally provides a good result, but during extreme conditions, for instance when the concentration of pollutants such as rags is very high, there is still a risk for clogging of the pump. Another situation when problems may occur is when the pump is installed in a dry position and the pump inlet is formed like a pipe. The inflow is then such, that the pollutants are concentrated and wound up on the impeller hub due to symmetry conditions.

The invention concerns a device for pumping of unscreened wastewater during special conditions, which eliminates the problems arising when known technique is used.

Figure 2:
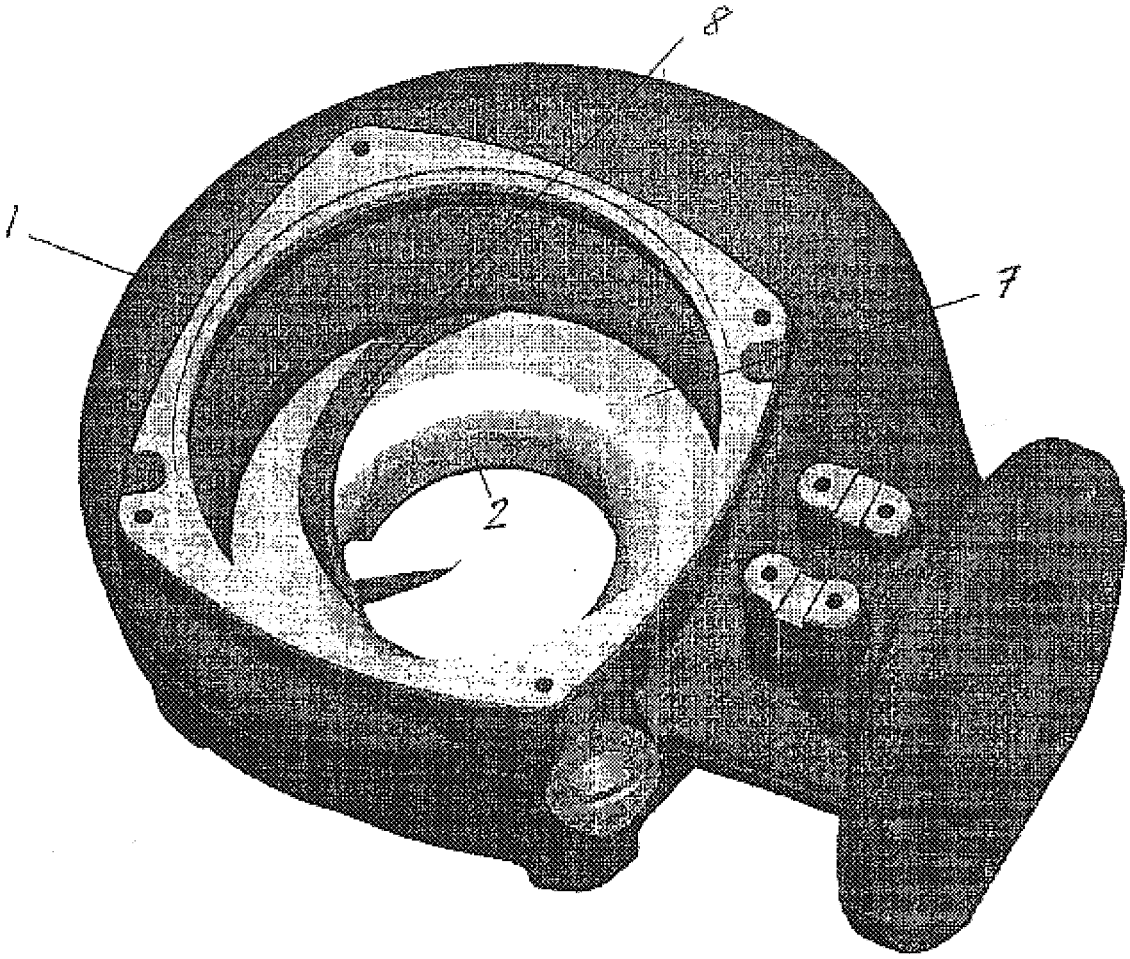
Figure 3:
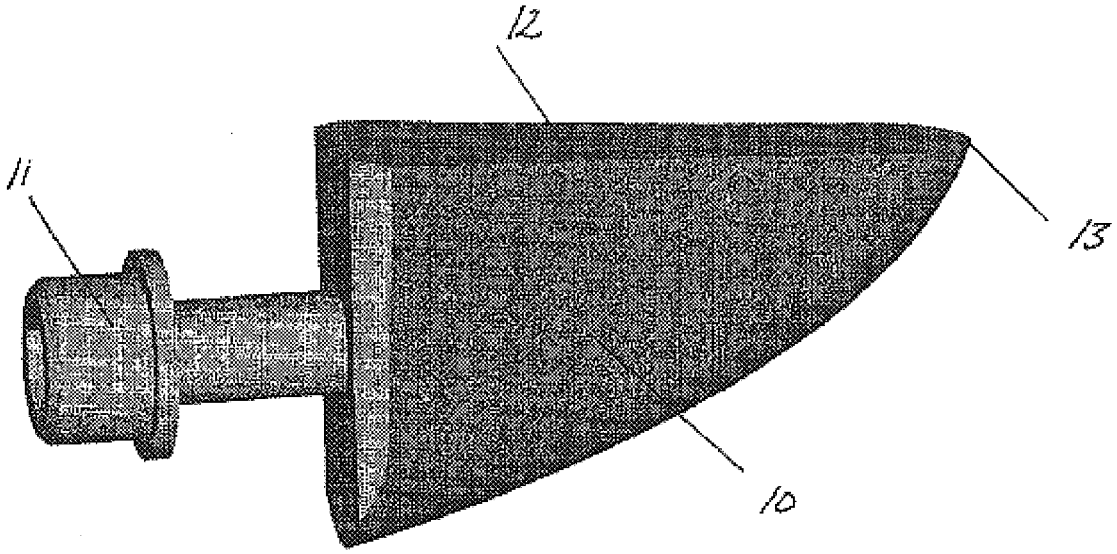

The invention is described more closely below with reference to the enclosed drawings. FIG. 1 shows a cut through centrifugal pump, FIG. 2 a view of a pump housing and FIG. 3 an essential part of the invention.

In the drawings, 1 stands for a centrifugal pump housing having a cylindrical inlet 2. 3 stands for a pump impeller having a central hub 4 and a vane 5. 6 stands for the leading edge of the vane, 7 the inner wall of the pump housing, 8 a groove in the wall, 9 the rotation direction of the impeller and 10 a scraping finger with attaching means 11, scraping surface 12 and center tip13.

An important principle with the invention is that the pollutants are not disintegrated by help of cutting means. In stead a more robust design is obtained, where the pollutants are transported towards the periphery.

The solution shown in SE-9704729-4, where grooves are provided in the inner wall of the pump housing, is according to the invention completed by one or several non rotating scraping fingers 10. Said fingers cooperate with the leading edges of the impeller vanes and feed the pollutants outward. The finger 10, which is attached to the pump housing wall, has a mainly radial and linear direction towards the impeller hub 4 and has a plane surface 12 heading, and in parallel with, the leading edge 6 of the vane. During rotation, the sweeping of the leading edge will feed the pollutants outward along one of the edges of the finger 10 towards the periphery where they are swallowed by the grooves 8.

To make sure that the pollutants do not stick between the parallel surfaces, the slot between them must be relatively narrow. An interval of 0.05 to 1 mm is possible, but the best result will normally be obtained within an interval of 0.1 to 0.5, preferably 0.2 0.4 mm. In order to secure that a correct width is obtained, the attachment 11 may me axially adjusted. According to a special embodiment, the finger 10 may have a sweeping directed opposite to the sweeping of the leading edge 6, which can have a positive influence on the feeding.

In order to obtain an optimal function it is important that the finger 10 itself does not cause clogging of the pump housing. The finger has therefore d design with a decreasing height in the direction of the center, thus allowing pollutants collected there to easily slide up onto the finger. In addition the finger is designed with rounded surfaces with the exception of the surface 12 heading the leading edge 6.

According to the invention, there is obtained a very favourable solution to the problems arising when pumping heavily polluted sewage water and other liquids containing long fibers. The invention is a development of the pumping principle described in the previously mentioned SE-512 154, SE-9704223-8 and SE-9704729-4. It has been described with reference to drawings showing a centrifugal pump. The invention is however not limited to be used with this type of pump, but can be applied with all sorts of rotary pumps, such as axial pumps etc.

What is claimed is:

1. A rotary pump for pumping of contaminated water including unscreened sewage water, comprising a pump housing (1) provided with a cylindrical inlet (2) and a pump impeller (3) having a central hub (4) and one or several vanes (5) the leading edges (6) of which being swept backwards and located within the inlet part (2) in a plane mainly perpendicular to the axis of rotation (z), one or several feeding grooves (8) being located in the inner wall of the pump housing (1) in a surface (7) opposing the leading edges of the vanes, said grooves being located upstream of the area of said leading edges and are swept from the inlet towards the outlet in the direction of the impeller rotation, characterized in, that at least one means (10) is attached to the pump housing (1) for scraping off pollutants on the leading edges (6) and feeding them towards the periphery within the area of the groove or grooves (8) in the pump housing wall, said means (10) having a plane surface (11) heading and in parallel with the leading edge (6) and located at a distance of 0.05 to 1 mm from said edge.

2. A rotary pump according to claim 1, characterized in, that the means (10) is directed mainly radially.

3. A rotary pump, according to claim 1, characterized in, that the means (10) is formed with a sweeping opposed to the sweeping of the leading edges (6) of the vanes.

4. A rotary pump according to claim 1, characterized in, that the means (10) is designed with an axially decreasing height in the direction of the center and ending with a tip close to the central hub (4).

5. A rotary pump according to claim 4, characterized in, that the parts of the means (10) that are turned away from the leading edge (6) are rounded.

6. A Rotary pump according to claim 1, characterized in, that the slot between the leading edge (6) and the plane surface of the means (10) has a width within the interval 0.1 to 0.5 mm, or 0.2 to 0.4 mm.

* * * * *